US008810132B2

(12) United States Patent
Fox et al.

(10) Patent No.: US 8,810,132 B2
(45) Date of Patent: Aug. 19, 2014

(54) MAGNETRON

(75) Inventors: David Bernard Fox, Chelmsford (GB); Robert Richardson, Chelmsford (GB)

(73) Assignee: E2V Technologies (UK) Limited, Chelmsford, Essex (GB)

( * ) Notice: Subject to any disclaimer, the term of this patent is extended or adjusted under 35 U.S.C. 154(b) by 0 days.

(21) Appl. No.: 13/637,286

(22) PCT Filed: Mar. 25, 2011

(86) PCT No.: PCT/GB2011/050616

§ 371 (c)(1),
(2), (4) Date: Dec. 18, 2012

(87) PCT Pub. No.: WO2011/117654

PCT Pub. Date: Sep. 29, 2011

(65) Prior Publication Data

US 2013/0082594 A1 Apr. 4, 2013

(30) Foreign Application Priority Data

Mar. 26, 2010 (GB) ..... 1005119.1

(51) Int. Cl.
*H01J 25/34* (2006.01)

(52) U.S. Cl.
USPC ..... 315/39.51; 315/39.53; 315/39.75; 315/39.55

(58) Field of Classification Search
USPC ..... 315/39.51–39.55, 39.77
See application file for complete search history.

(56) References Cited

U.S. PATENT DOCUMENTS

| | | | | | |
|---|---|---|---|---|---|
| 2,532,215 | A | * | 11/1950 | Williams | 313/37 |
| 2,906,921 | A | * | 9/1959 | Gardiner | 315/39.69 |
| 3,113,272 | A | * | 12/1963 | Cannon et al. | 102/200 |
| 4,053,850 | A | * | 10/1977 | Farney et al. | 331/91 |
| 4,194,142 | A | * | 3/1980 | Gerard | 315/39.77 |
| 4,300,072 | A | * | 11/1981 | Tashiro | 315/39.51 |
| 4,459,563 | A | * | 7/1984 | Kawaguchi | 331/91 |
| 4,705,989 | A | * | 11/1987 | Takada et al. | 315/39.51 |
| 8,129,911 | B2 | * | 3/2012 | Wilson | 315/94 |

FOREIGN PATENT DOCUMENTS

| | | | |
|---|---|---|---|
| EP | 0219093 | A3 | 11/1988 |
| EP | 1284425 | A2 | 2/2003 |
| JP | 3187129 | | 8/1991 |
| KR | 100668115 | | 1/2007 |
| WO | WO-2006/023257 | A1 | 3/2006 |

OTHER PUBLICATIONS

International Search Report of PCTGB2011/050616 Dated May 24, 2011.
United Kingdom Search Report of Application No. GB1005119.1 Dated Aug. 6, 2010.

* cited by examiner

*Primary Examiner* — Douglas W Owens
*Assistant Examiner* — Srinivas Sathiraju
(74) *Attorney, Agent, or Firm* — Venable LLP; Robert Kinberg; F. Brock Riggs

(57) ABSTRACT

A magnetron has an anode and a cathode. The cathode includes two parts joined by sleeves of ferrous alloy spaced by a sleeve of insulating material. The ferrous alloy sleeves are adapted to be connected to opposite poles of a power supply for heating the cathode. A high frequency power supply is used to heat the cathode. The ferrous alloy sleeves have a surface coating of conductive material. The currents induced by the magnetic field generated by the high frequency currents of the power supply are largely confined to the conductive coating due to the skin effect, avoiding the heating of and losses in the ferrous alloy itself which would otherwise ensue.

12 Claims, 2 Drawing Sheets

MAGNETRON

CROSS-REFERENCE TO RELATED APPLICATION

This application is a National Stage Application of International Application No. PCT/GB2011/050616, filed Mar. 25, 2011, which claims the priority of Great Britain Patent Application No. 1005119.1, filed Mar. 26, 2010.

BACKGROUND OF THE INVENTION

This invention relates to magnetrons.

Referring to FIG. 1 of the accompanying drawings, which is an axial section through a known magnetron, a known magnetron consists of a hollow anode 1 into which a cathode indicated generally by the reference numeral 2 extends. RF power may be coupled out of the anode into a waveguide (not shown) by coupler A housed in ceramic dome B. Input power is provided by a HT d.c. power supply 3 between the cathode and the anode, with the anode typically being at ground potential and the cathode at a high negative potential. The interaction space between the anode and cathode is evacuated and, in order to hold off the HT voltage between the anode and cathode, a sleeve 4 of insulating material forms part of the vacuum envelope. The sleeve 4 is bonded to the anode and cathode, respectively, by alloy sleeves 5, 6. The cathode is hollow, and consists of an outer sleeve 7 containing a core 8, and the emissive part of the cathode is a bright emitter helical filament 9. To complete the vacuum envelope at its upper end, an outwardly-flared region 10 of the cathode sleeve is bonded to the end of the core 8 by means of alloy sleeves 11, 12, which are separated from each other by an insulating sleeve 13. The sleeves 11, 12 are made of Kovar, a nickel cobalt ferrous alloy, in order to have a coefficient of thermal expansion compatible with that of the insulating sleeve 13, which is of ceramic material. A power supply to heat the filament is applied between the head of the core and the flared portion of the cathode outer sleeve. The power supply includes an isolation transformer indicated generally by the reference numeral 14, the primary of which is driven by the mains C, and also earthed, the output of the secondary being superimposed on the high negative voltage applied to the cathode by d.c. supply 3.

The transformer operates at mains frequency, but this is a disadvantage, because the insulation between primary and secondary is heavy and bulky.

It would be preferred to operate transformer 14 at high frequency, because the size and weight of the transformer would be greatly reduced.

However, this would have the disadvantage of causing significant heating and power loss because power will be dissipated in the material of the alloy sleeves 11, 12.

Thus, a high frequency supply from the secondary of the transformer 14 would generate a high frequency alternating current travelling along the core 8 and returning along the flared region 10. Since Kovar is a ferromagnetic material, significant magnetic flux would be generated circulating through the bulk of the sleeve 12, also alternating at high frequency. This in turn would generate currents in the sleeve 12, which would cause power loss. The same situation applies to sleeve 11.

It has been proposed in JP3187129 to provide a capacitor type HV input terminal to a magnetron, which input terminal is coated with a conductive layer and carries a high frequency filament current.

SUMMARY OF THE INVENTION

The invention provides a magnetron, in which the cathode includes two parts joined by sleeves of ferrous alloy spaced by a sleeve of insulating material, the ferrous alloy sleeves having magnetic flux induced in them, in use, from a high frequency supply for heating the cathode, and the ferrous alloy sleeves having a surface coating of conductive material.

The coating enables the power loss caused by the cathode heater currents induced by the magnetic flux by the high frequency supply to be reduced in the ferrous alloy sleeves.

BRIEF DESCRIPTION OF THE DRAWINGS

One way of carrying out the invention will now be described in detail, by way of example, with reference to the accompanying drawings, in which.

Like reference numerals have been given to like parts throughout all the drawings.

DETAILED DESCRIPTION OF THE EMBODIMENTS

Figure 1:
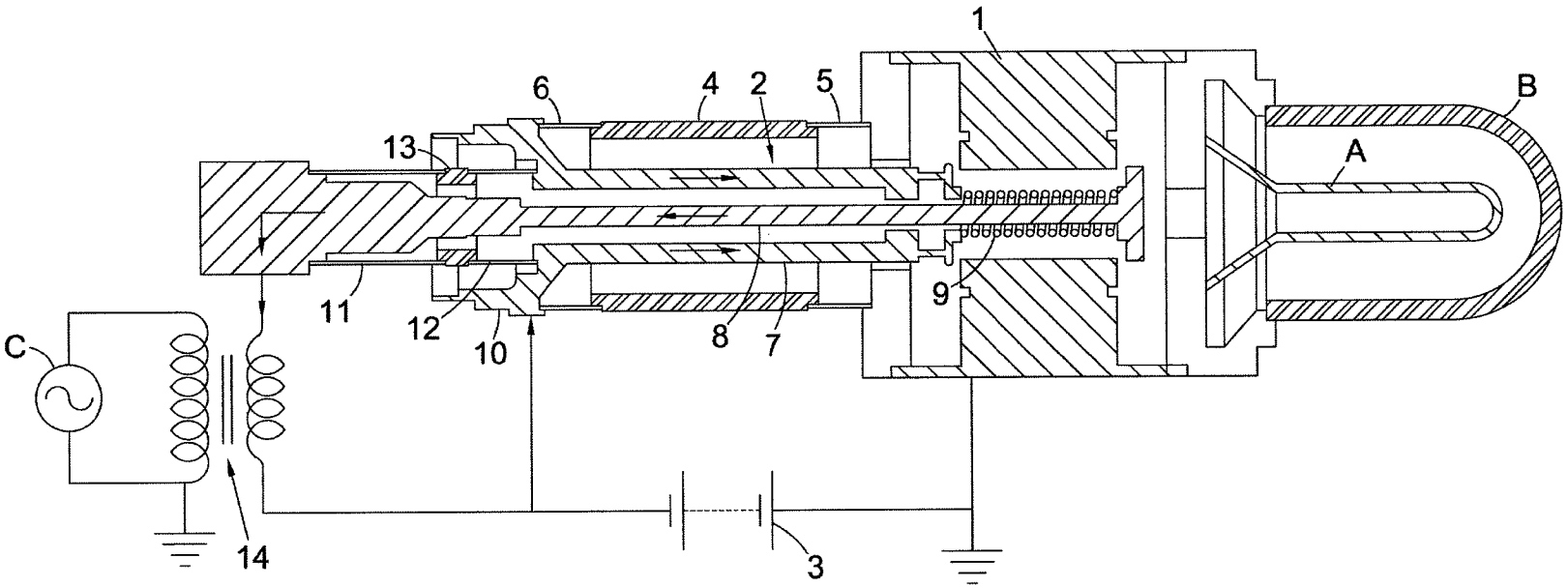
FIG. 1 is an axial section through a known magnetron.

The magnetron of the invention differs from the known magnetron by virtue of the type of filament (cathode) heater power supply, and by virtue of the sleeves 11, 12. Only the sleeve 12 is illustrated (sleeve 11 will be the same), because the remainder of the magnetron is as illustrated in FIG. 1.

In accordance with the invention, the input of the transformer 14 is driven by a high frequency switched mode power supply D, instead of being driven at mains frequency. The bulk of the isolation transformer is thus greatly reduced compared to one operating at mains frequency.

Also, in accordance with the invention, the sleeves 11, 12 are of Kovar as before, but now have a surface coating of conductive material 15.

Figure 2:
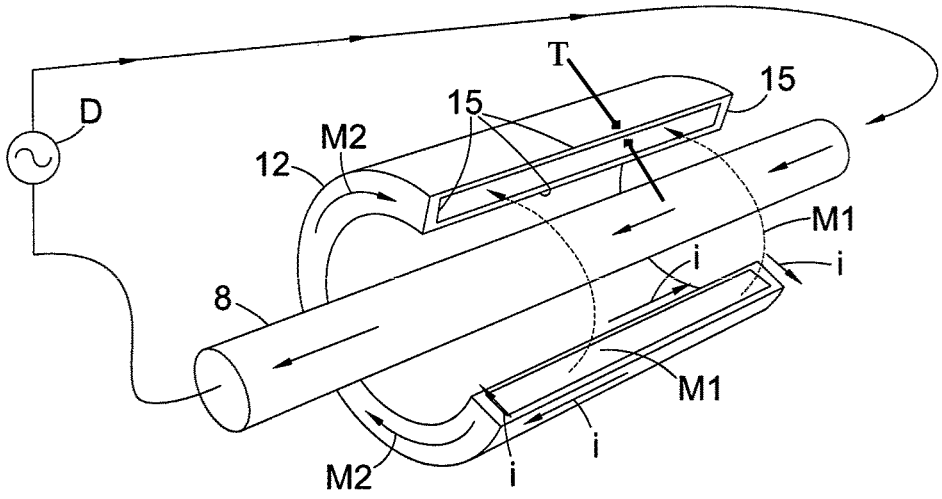
FIG. 2 is an enlarged perspective view of the sleeve 12 of the magnetron of the invention.

Referring to FIG. 2, an azimuthal magnetic flux M1 will circulate around the sleeve 12 due to the high frequency alternating current travelling along the sleeve 7 and core 8 of the cathode 2 (shown in FIG. 2 symbolically by the arrows indicating the current at one instant in the cycle). Each incremental part of the circumference of the sleeve 12 will see the induced magnetic flux, and this will have the effect of generating current loops i around each incremental part of the sleeve in a direction parallel to the axis of the sleeve 12. In turn, these currents induce an azimuthal magnetic flux M2 in the sleeve 12 in the opposite sense to, and cancelling, the flux M1. This is in the manner of Lenz's Law, or the behaviour can be thought of as being like a shorted turn of a secondary of a transformer.

Because the currents in the sleeve and the core are high frequency, the induced magnetic field will be a high frequency alternating field, and the induced currents i will likewise be high frequency. It follows that, due to the skin effect, those high frequency currents i will predominantly be carried in the surface coating of conductive material, and very little will be carried by the Kovar itself. Hence, there will be little if any heating and losses in the body of the Kovar itself.

An advantage of the arrangement is that the same performance can be attained from the magnetron as with previous heater supplies operating at mains frequency, but the heater supply and isolation transformer are now provided by smaller, lighter and cheaper components (for example, an isolation transformer operating at 50 or 60 Hz can weigh about 100 kg, while one operating at 15 kHz can weigh only 1 kg).

It is convenient to coat the entire inner and outer curved surfaces of the sleeves with conductive material, but this is not essential. For example, the sleeves may be coated only on the inner curved surface, or only on the outer curved surface. Furthermore, whether the coating is on one curved surface or both, it is not necessary for the coating to be complete. For example, the coating could be in the form of strands of conductive material extending in an axial direction, or could be in the form of a mesh. Copper is preferred for the conductive material, but conducting material other than copper could be used, for example, silver or any other material with low resistivity.

In the case of copper, a uniform coating thickness T on the inner and outer curved surfaces of from 1 micron ($10^{-6}$ m) to 50 microns, preferably from 5 microns to 30microns, may be provided.

Furthermore, it is not necessary for the material of the sleeves bearing the conductive with that of the insulating sleeve may be used, for example, the nickel-iron group of alloys.

The frequency of the switched mode power supply D can be in the range of from 1 kHz to 1 MHz, but is preferably in the range of from 10 kHz to 500 kHz. The power supply D does not have to be switched mode. Other designs of high frequency supply may instead be used.

The invention claimed is:

1. A magnetron comprising: a hollow cathode including a filament as an electron emissive part, and an outer sleeve containing a core, the hollow cathode being arranged to apply a high frequency voltage between the outer sleeve and the core to heat the filament; and sleeves of ferrous alloy spaced by a sleeve of insulating material joining the core and the outer sleeve, the ferrous alloy sleeves having magnetic flux induced in them, in use, from the high frequency voltage that heats the filament, and the ferrous alloy sleeves having a conductive surface coating with a resistivity of substantially that of copper or silver.

2. The magnetron as claimed in claim 1, in which the frequency of the high frequency voltage is within the range of from 1 kHz to 1 MHz.

3. The magnetron as claimed in claim 2, in which the frequency of the high frequency voltage is within the range of from 5 kHz to 500 kHz.

4. The magnetron as claimed in claim 1, in which the conductive material is continuous on both inner and outer curved surfaces of the ferrous alloy sleeves.

5. The magnetron as claimed in claim 4, in which a thickness of the conductive coating is within the range of from 1 micron to 50 microns.

6. The magnetron as claimed in claim 5, in which the thickness of the conductive coating is within the range of from 5 to 30 microns.

7. The magnetron as claimed in claim 1, in which the conductive material is copper.

8. The magnetron as claimed in claim 1, in which the ferrous alloy of the sleeves is a nickel cobalt ferrous alloy.

9. The magnetron as claimed in claim 8, in which the ferrous alloy is Kovar.

10. The magnetron as claimed in claim 1, in which the insulating material is a ceramic material.

11. The magnetron as claimed in claim 1, in which a connection of the ferrous alloy sleeves to the sleeve of insulating material is a vacuum tight connection.

12. The magnetron as claimed in claim 1, in which the ferrous alloy sleeves include a first ferrous alloy sleeve and a second ferrous alloy sleeve, and the first ferrous alloy sleeve, the sleeve of insulating material, and the second ferrous alloy sleeve are juxtaposed along a common central axis.

* * * * *